United States Patent [19]

Watarai

[11] Patent Number: 4,878,428

[45] Date of Patent: Nov. 7, 1989

[54] CONTROL METHOD OF TRANSPORTING A CUT SHEET IN A PRINTING STATION AND AN APPARATUS USING THE SAME

[75] Inventor: Shinichi Watarai, Yokohama, Japan

[73] Assignee: Fujitsu Limited, Kawasaki, Japan

[21] Appl. No.: 230,612

[22] Filed: Aug. 10, 1988

[30] Foreign Application Priority Data

Aug. 12, 1987 [JP] Japan ..... 62-201140

[51] Int. Cl.[4] ..... B41F 1/54

[52] U.S. Cl. ..... 101/484; 400/119; 400/708; 355/206; 355/309; 271/262

[58] Field of Search ..... 400/119, 708, 708.1; 271/3, 256, 258, 259, 260, 261, 262, 263; 355/14 S H, 3 R, 3 S H, 14 R; 101/484

[56] References Cited

U.S. PATENT DOCUMENTS 4,763,162 8/1988 Yagasaki ..... 271/263

FOREIGN PATENT DOCUMENTS 36054 2/1984 Japan ..... 271/262

*Primary Examiner*—Eugene H. Eickholt

*Attorney, Agent, or Firm*—Staas & Halsey

[57] ABSTRACT

In a high speed printing station, cut sheets are separated one by one sequentially and transferred through the printing station. When a sheet jamming occurs in the feeding unit all sheet transport means are stopped, the previous sheets remaining and moving in the printing and ejecting units are wasted and components in the printing unit are contaminated by toner powder. The control method of the present invention comprises steps of (a) detecting the sheet jamming occurring in the feeding unit by a first sensor, (b) stopping the transporting means in the feeding unit only, (c) continuing operation of other transport means until the second sensor in the ejecting unit detects an ejection of all previous sheets in the printing and ejecting units, and (d) stopping the other transport means. The sheets except the jammed one become available for use and the contamination by toner powder is avoided.

25 Claims, 5 Drawing Sheets

FIG. 1
PRIOR ART
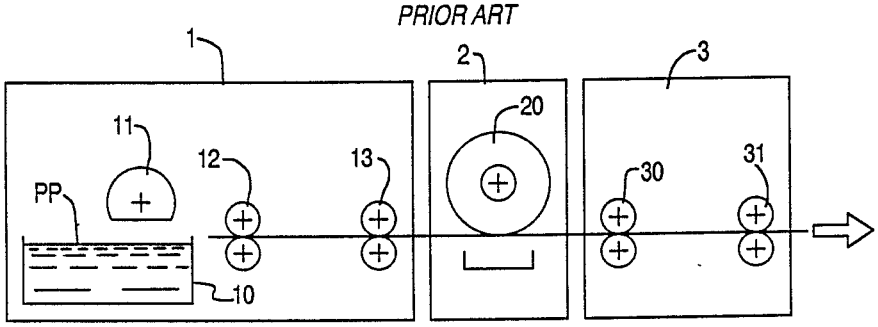
FIG. 2
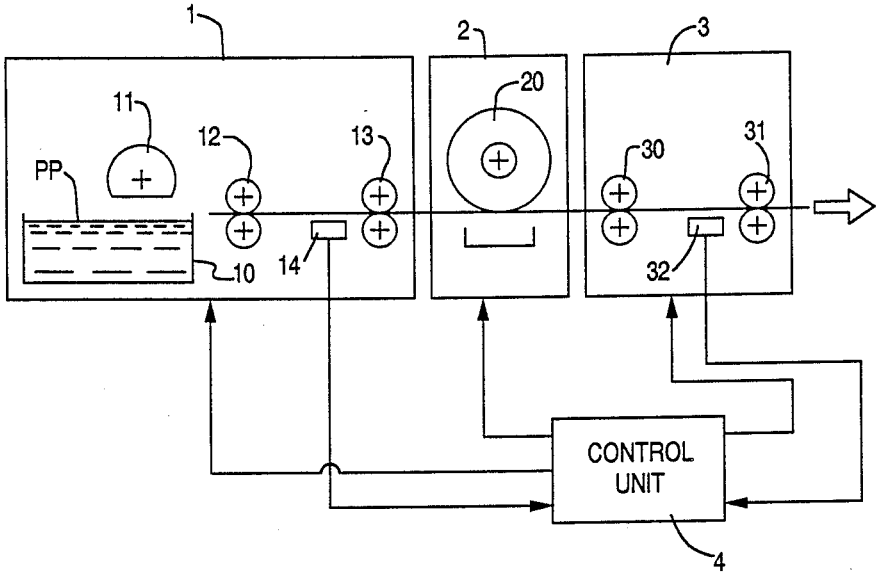
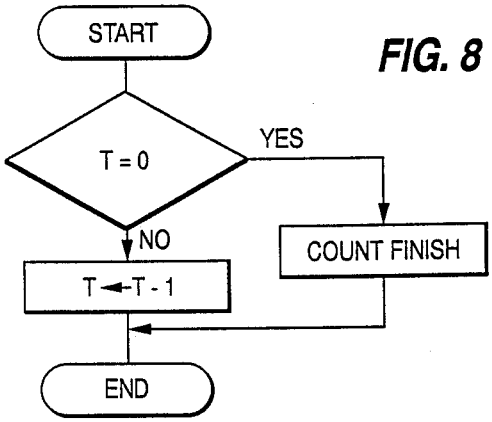
FIG. 8

PRT COMMAND
MAIN MOTOR START
TIMER START
PICK ON
TM > T1
NO
YES
1
TIMER START
CL1 ON
WT
POS
ON
NO
YES
2
CL1 OFF
WRITE ON
NO
YES
3
TIMER START
TM = T3
NO
YES
TIMER START
CL1,CL2 ON
TM > T4
NO
YES
4
CL1,CL2 OFF
TIMER START
TM > T5
NO
YES
5
SECOND
SENSOR
OFF
NO
YES
END
TM > T2
NO
YES
CL1 OFF
6
SECOND
SENSOR
OFF
NO
YES
MAIN MOTOR STOP
ALARM ON
7

CONTROL METHOD OF TRANSPORTING A CUT SHEET IN A PRINTING STATION AND AN APPARATUS USING THE SAME

BACKGROUND OF THE INVENTION

1. Field of the Invention

The present invention relates to a printing station utilized in apparatus such as a printer, facsimile or copying machine, wherein a cut sheet of paper is used as a recording medium and the cut sheet is fed continuously to the printing station and printed thereon with a high speed. More particularly, the invention relates to a control method of stopping plural transport means when a feed failure of the cut sheet is detected during operation.

In the printing station with a high speed, a cut sheet is separated from stacked sheets provided by a cassette one by one. The cut sheet is transferred by a transport means in a feeding unit even when the previously transferred sheet is still remaining and moving in a printing and ejecting units. Therefore, the sequence to stop each transport means at a proper time is an important problem when the cut sheet is jammed.

2. Description of the Prior Art

FIG. 1 shows outline structure of the conventional printing station comprising a feeding unit 1, a printing unit 2 and an ejecting unit 3. Cut sheets PP are provided and stacked in a hopper 10, usually in a sheet cassette. Each sheet is separated one by one by a rotation of a separating roller 11, and is transferred by a movement of a feed roller pair 12 and a register roller pair 13 into printing unit 2.

In a printing unit 2, a latent image of printing information is formed by an optical means (not shown) on a photoconductive drum 20, and is developed by toner powder during a rotation thereof. The developed toner image is transferred onto the contacting and moving sheet and is fixed by a heat roller (not shown).

The printed sheet is transferred into an ejecting unit 3, and two roller pairs 30 and 31 eject the sheet into a stacker (not shown). When a cut sheet is jammed at a specific roller position in the printing station, the sheets are jammed one after another at this position. This causes an overload to the main motor which drives all transport means, finally resulting in a standstill of operation. In the prior art, therefore, all movements of the printing station are stopped as soon as the sheet jamming is detected by a sensor.

Where the printing speed is not too fast such that the next sheet is transported after the previous sheet is ejected from the printing station, the above method of stopping all movements of transport means in the printing station does not become a serious problem. However in the high speed printing station of FIG. 1, the cut sheet is separated and transferred to the position of a register roller pair 13 provided just before the inlet of the printing unit 2 and waits for a while in order to synchronize the sheet's movement with printing operation. This movement of separating and transferring the sheet starts while the previous sheet is still in a printing process. If a sheet jamming is detected in the feeding unit 1 and all transport means in the printing station are stopped, the previous sheets, which are still remaining in the printing and ejecting units 2 and 3 cannot be used again, because the printing quality thereon becomes inferior, and moreover, the sheet during the fixing operation is overheated and scorched by the heat roller. The fixing unit is contaminated by toner powder and good quality of printing cannot be expected even when the operation is resumed after removal of the jammed sheet.

SUMMARY OF THE INVENTION

It is a general object of the invention, therefore to provide a control method of transporting a cut sheet in a high-speed printing station and an apparatus using the above method.

It is another object of the invention to provide the control method of transporting and the apparatus of a high-speed printing station when the sheet is jammed during operation.

It is a specific object of the invention to provide the control method of transporting a cut sheet in a high-speed printing station and the apparatus using the method, wherein, when a sheet is jammed in the feeding unit 1, the previous sheets remaining and moving in the printing and ejecting units 2 and 3 are made available for use.

It is a further object of the invention to provide the control method of transporting a cut sheet and the apparatus in a high-speed printing station avoiding component contamination by toner powder in the printing unit.

Foregoing and related objects are accomplished by the control method of the invention and the apparatus, wherein two sensors are provided in the feeding unit and ejecting unit respectively, and when the first sensor provided in the feeding unit detects the sheet jamming, only the transport means in the feeding unit are disconnected from the main motor, and other transport means in the printing and ejecting units are maintained to run until the second sensor detects that other previously fed sheets before the jammed sheet are ejected from the ejecting unit, and thereafter these transport means are stopped.

Accordingly, a control unit for the transport means is provided for the printing station. In the control unit, the time is counted for each cut sheet to travel from the hopper position to the register position, and the arrival of a sheet is detected by the first sensor and compared with a predetermined time data. If the counted time exceeds the predetermined time date, it is judged that a sheet is jammed in the feeding unit.

The second sensor is disposed near an outlet of the ejecting unit adjacent to a stacker and has a function of detecting every sheet passing over the second sensor. The control unit generates a command to turn-off the circuit which drives the main motor coupled to all transport means upon receiving a signal such that all sheets are ejected from the printing and ejecting units. Therefore, the present invention makes it possible to avoid further troubles such as removal of the sheets in the printing and ejecting units and avoids the damage of the printed information thereof, and further avoids contamination of the sheets and parts in the printing units.

Other objects and advantages of the present invention will become apparent from the detailed description to follow taken in conjunction with the appended claims.

BRIEF DESCRIPTION OF THE DRAWINGS

FIG. 1 shows a schematic side view of an outline structure of a conventional printing station of the prior art, FIG. 2 shows schematically a side view and a circuit connection to a control unit in the present invention, FIGS. 6 and 8 show a flow chart of the control method of the present invention and a flow chart for explaining an inner timer means respectively.

DETAILED DESCRIPTION OF THE PREFERRED EMBODIMENTS

The outline structure of the embodiment will herein be described.

Figure 3:
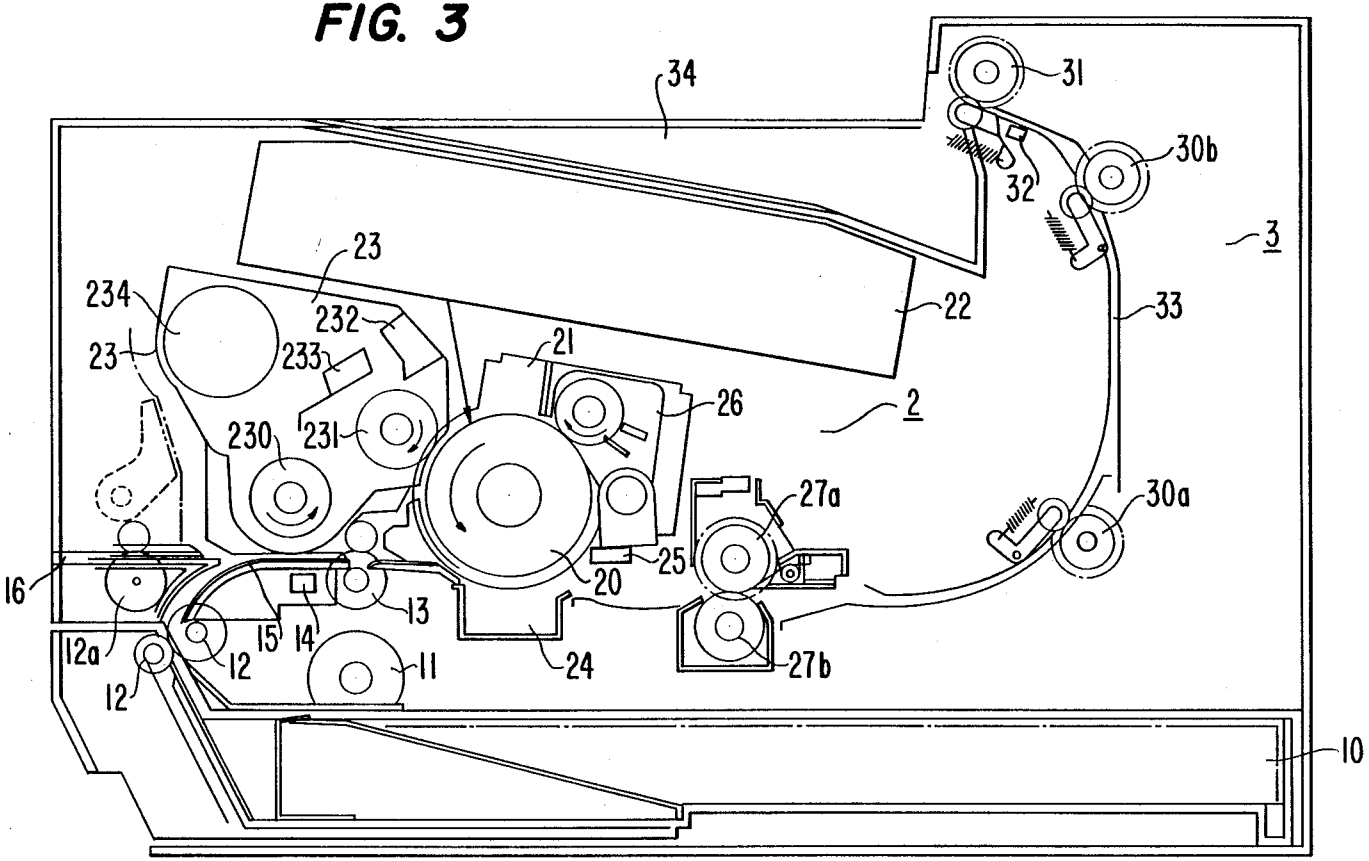
FIG. 3 shows a side view of the detailed structure of the printing station of the embodiment.
Figure 4:
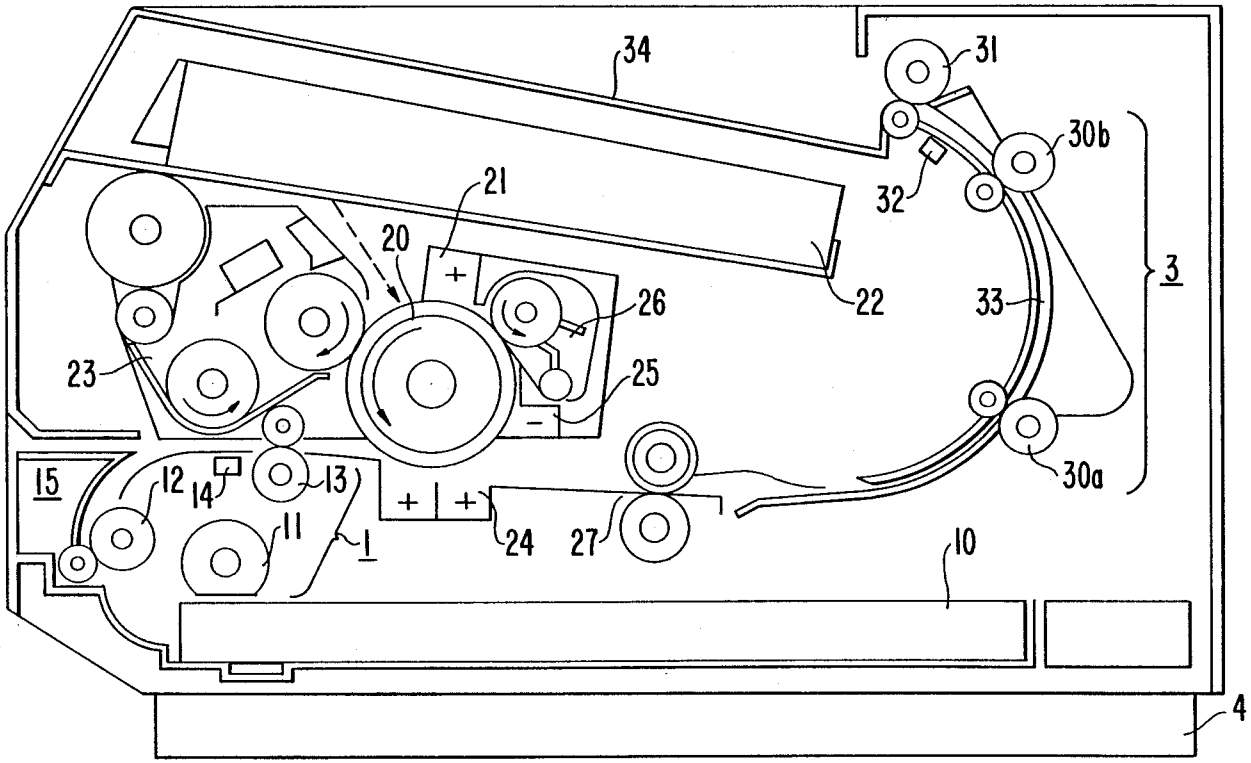
FIG. 4 shows a simplified side view of the structure of the embodiment of FIG. 3.

FIG. 2 shows a schematic side view of a printing station for explaining the control method of the present invention. FIG. 3 shows a side view of the detailed structure of the printing station and FIG. 4 shows a similar side view, wherein the transport passage of the sheet is more clearly illustrated with regard to other components in the printing station. Same or like reference numerals designate same or corresponding parts throughout the drawings.

A cassette 10 loaded with stacked cut sheets of paper is provided in a lower portion of the printing station as shown in FIG. 3. Each cut sheet (hereafter, briefly called a sheet) of paper is separated from the stacked sheets and transferred by a separating roller 11 by the rotation thereof, the rotation being controlled from a control unit 4 disposed at the bottom of the equipment as shown in FIG. 4. The separated sheet in FIG. 3 then transferred by a feed roller pair 12 along a feed passage 15 to a register position where the front end of the sheet is contacting with a register roller pair 13. In the embodiment, a sensor 14 is provided in a close vicinity of the register roller pair 13. At this point the sheet is standing by for a while for a further transport. Another feed passage is provided for a manual insertion of a sheet. The sheet is inserted through an inlet 16 and transferred to the register position by a feed roller 12*a*.

These components comprising the separating roller 11, feed roller pair 12, and register roller pair 13 compose a sheet feeding portion of the printing station. This portion is briefly called a feeding unit 1 and is shown in FIG. 4.

The sheet is further transferred into a printing unit 2 by a command of the control unit 4, the restart time of the feed roller pair 12 and register roller pair 13 being controlled such that the printing operation in the printing unit 2 is synchronous with the movement of the sheet. The components utilized in the printing unit 2 are similar with those used in a conventional laser printer, wherein a charger 21 charges a photoconductive drum 20, the charged drum is exposed to a beam of modulated light generated by an optical system 22, an electrostatic latent image is formed on the photoconductive drum 20, the electrostatic latent image is developed to a toner image by a developing device 23, the toner image is transferred on the moving sheet with a function of an image transfer device 24, and finally the sheet is transported to a fixing roller pair 27 where the toner image pattern on the sheet is fixed.

In the developing device 23 of FIG. 3, a paddle roller 230 rotates counter-clockwise and stirs toner and carrier powder, and a developing roller 231 rotates clockwise forming a magnetic toner brush, the height thereof being maintained constant by the action of a doctor blade 232. The magnetic toner brush develops the electrostatic latent image on the photoconductive drum 20. The removed toner and carrier powder by the doctor blade 232 returns to the paddle roller 230 through a return path member 233. The toner powder is supplied from a reservoir 234 to supplement the consumed toner powder.

The printing unit 2 further provides a discharger 25 in order to discharge electrical charges on the surface of photoconductive drum 20 after the transfer of the toner image, and a cleaning device 26, wherein a cleaning brush rotates and scrapes away the remaining toner powder. After passing through the image transfer device 24, the sheet is further transferred to the fixing roller pair 27 which consists of a heat roller 27*a* and a counter roller 27*b*. The toner pattern on the sheet is fused and fixed.

The ejecting unit 3 composes mainly a transport passage 33 for the printed sheet to a stacker 34 with transporting means therefor. In the embodiment of FIGS. 3 and 4, the passage from the cassette 10 to the stacker 34 forms and "S" character shape, which contributes to make the laser printer compact and to stack the printed sheet one by one in such a way that its printed surface is facedown. Therefore, the printed sheets do not need to be rearranged in the order of printing. The transport means in the ejecting unit comprising two conveying roller pairs 30*a* and 30*b* and an ejecting roller pair 31 just before the stacker 34. In the embodiment, a sensor 32 is provided in a close vicinity of the ejecting roller pair 31, which detects the passing sheet, specifically, the arrival of front end of the sheet and the departure of bottom end of the sheet.

Figure 5:
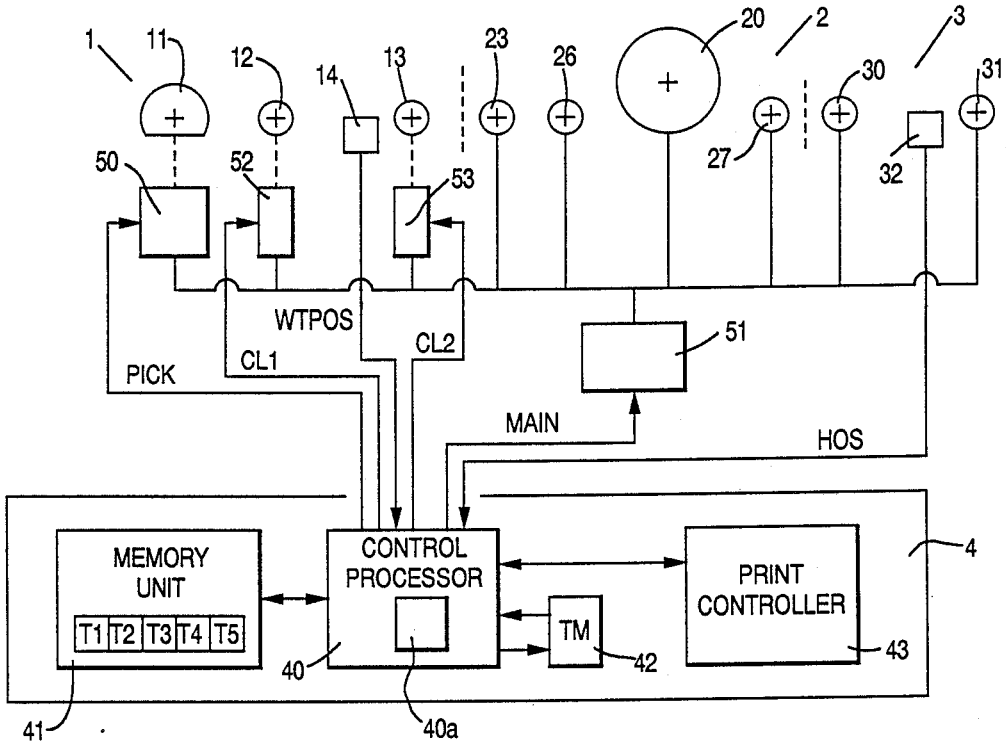
FIG. 5 shows a block diagram for explaining the control method of the present invention.

FIG. 5 is a block diagram showing the control method of transport means used in the embodiment shown in FIGS. 2 to 4. Same reference numerals are used to identify the same or similar parts in FIG. 5. The control unit 4 comprises a control processor 40, a print controller 43, a memory unit 41, and an inner timer means 40*a* and an outer timer means 42. The control processor 40 comprises a microprocessor and other logic circuit means (not shown), and it controls the sequence of operation of the printing station. The memory unit 41 stores a necessary program to operate the control processor 40, and further stores a plurality of predetermined time data.

A plurality of predetermined time data is utilized such as $T_1$ defined as the switch-on duration of the separating roller 11, $T_2$ defined as the duration required for the separated sheet to travel to the register position by the feed roller pair 12, $T_3$ defined as the duration required for the register roller pair 13 to wait after the print command is issued to the printing unit 2, $T_4$ defined as the duration required for the sheet to pass completely through the register roller pair 13, namely, from the front end to the bottom end of the sheet, and $T_5$ defined as the duration required for the sheet to proceed from the position of a complete introduction of the sheet into the printing unit 2 to the position of the bottom end thereof passing over the second sensor 32.

As the timer means such as 40*a* and 42, either a software timer (inner timer 40*a*) provided in the control processor 40 or a hardware timer (outer timer 42) provided separately may be utilized. In the embodiment, a plurality of timer means are utilized. In FIG. 5, one outer timer means 42 and one inner timer means 40*a* are illustrated representatively. The timer counts the duration required for the sheet to proceed from the specific position to another specific position or the duration required for the sheet to complete the specific operation. If the abnormal count is detected, the control processor 40 generates a stop command to the specific portion of the equipment. Further details are explained later.

In FIG. 5, three clutch means 50, 52, and 53 are illustrated, each clutch means connect and disconnect the driving torque of the main motor 51 to the separating roller 11, feed roller pair 12 and register roller pair 13 respectively. The main motor 51 also drives all other rotatable parts such as the photoconductive drum 20, the developing device 23, the cleaning device 26, the fixing roller pair 27, the conveying roller pairs 30*a* and 30*b*, the ejecting roller pair 31, and etc. In FIG. 5, solid lines connecting between the main motor 51 and each of rotating parts mean that the driving torque of the main motor is transmitted to these parts via clutch means, gear means, belt means, pulley means, and etc.

A sensor 14 is provided along the sheet passage in a close vicinity before the register roller pair 13, and another sensor 32 is also provided before the ejecting roller pair 31. Each sensor sends an on-signal and off-signal to the control unit 4 when it detects the front end and bottom end of the sheet respectively.

The operation of the embodiment will herein be described.

Figure 7:
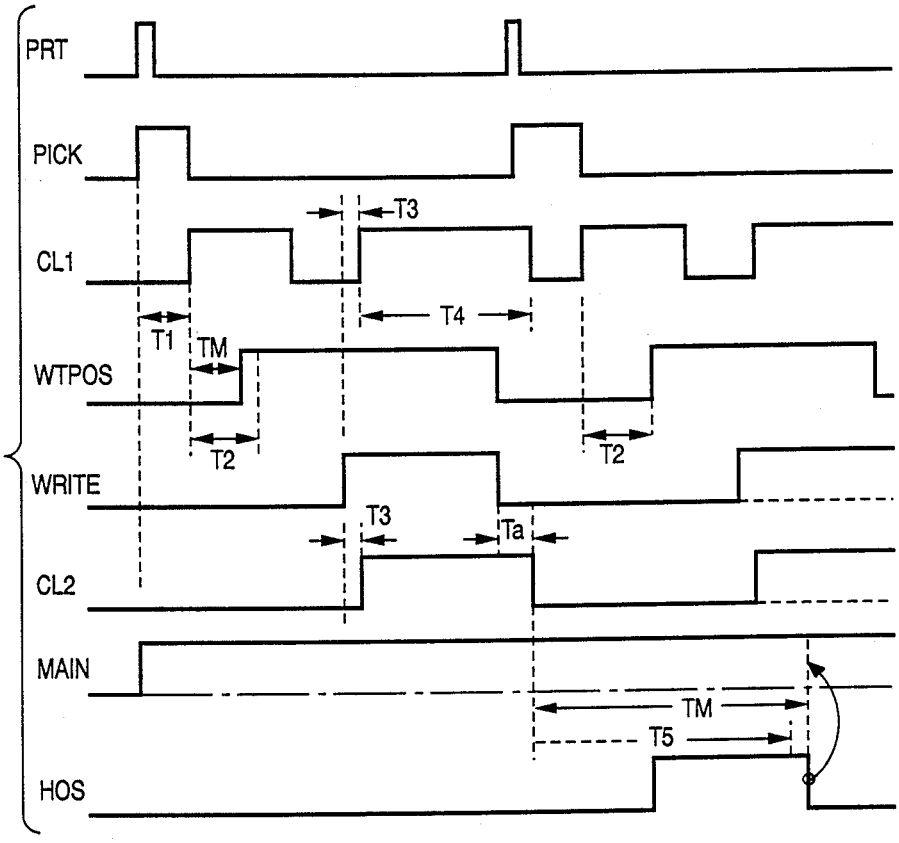
FIG. 7 shows a timing chart for the operation of the control method of the present invention.
Figure 6:
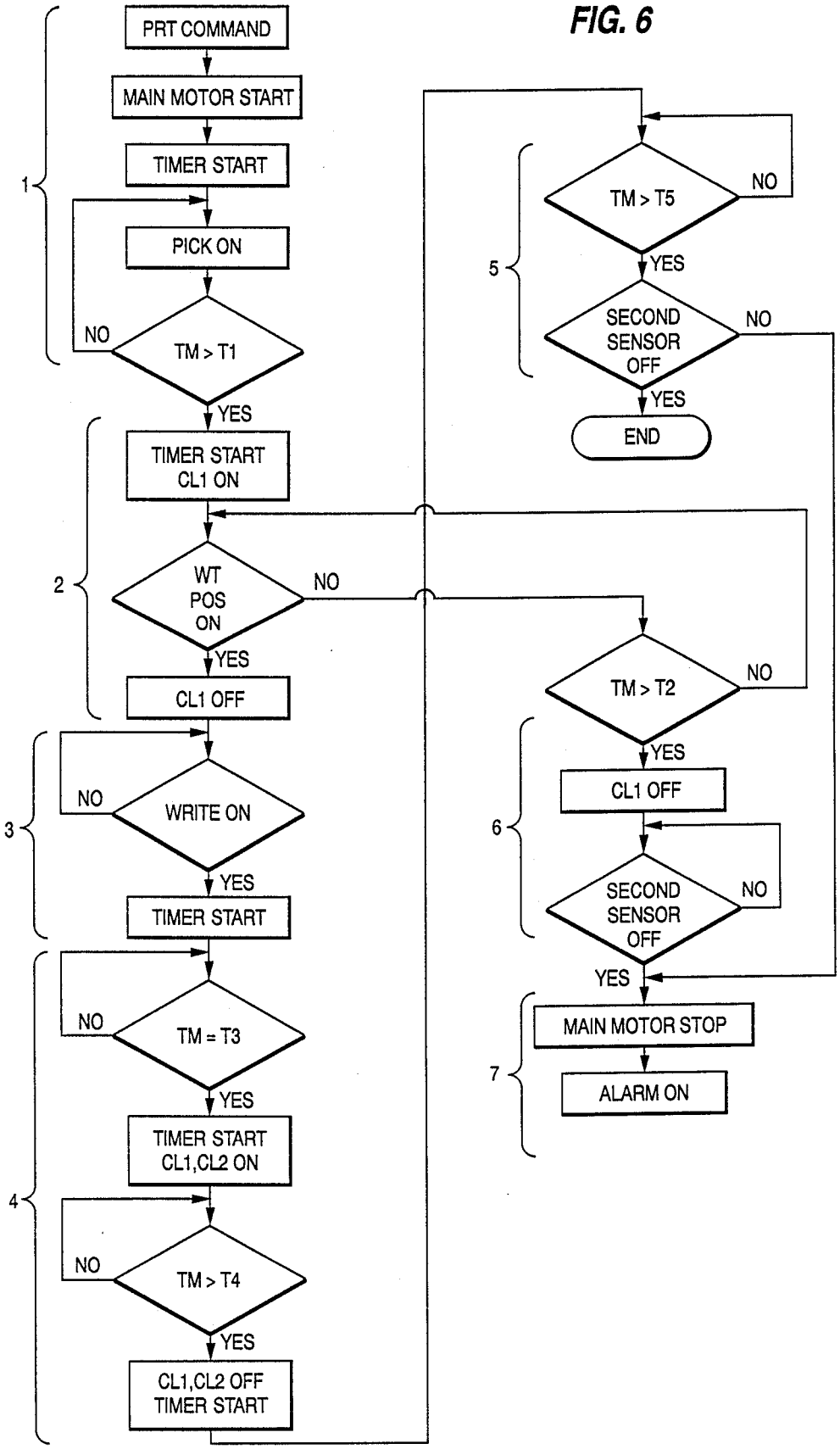

The FIG. 6 shows a flow chart of the embodiment of the present invention and FIG. 7 shows a timing chart thereof.

The encircled numeral references from 1 to 7 denoted on the left side of the flow chart of FIG. 6 designates the specific step in the following explanation.

(1) When the print command PRT is issued to the control processor 40 in FIG. 5, the control processor 40 generates a command MAIN, by which the power for driving the main motor 51 is turned on. The main motor begins to rotate all rotatable components such as the photoconductive drum 20, developing device 23, fixing roller pair 27 and etc. in the printing unit 2, and the conveying roller pair 30 and ejecting roller pair 31 in the ejecting unit 3. At this moment, the separating roller pair 11, the feed roller pair 12 and register roller pair 13 are disconnected from the main motor 51 by the clutch means 50, 52 and 53 respectively.

The control processor 40 loads clutch-on time data $T_1$ into the timer means 40*a*, time data $T_1$ being stored in the memory unit 41. During the duration $T_1$, the separating roller 11 is connected to the main motor 51 by the clutch means 50 rotates, and separates and transfers a single cut sheet. $T_1$ is shown as a signal PICK in FIG. 7. When the timer means 40*a* counts (counted time is denoted TM in FIG. 6) down $T_1$, the PICK signal is turned off.

(2) After the time $T_1$ has passed, the control processor 40 commands that the new time data $T_2$ is loaded in the inner timer means 40*a*. At the same time when the timer means begins to count, the clutch means 52 connects the feed roller pair 12 to the main motor 51 by a clutch on-off signal CL1 in FIG. 7, and the feed roller pair 12 begins to rotate and transfer the sheet which is separated by the separating roller 11.

When the front end of the sheet arrives over the sensor 14, which is disposed near the register roller pair 13, the sensor sends a signal WTPOS in FIG. 7. When the time data, which is counted by the inner timer means 40*a* till the rise time of the WTPOS signal, is shorter than the predetermined time data $T_2$, the feed roller pair 12 is disconnected from the main motor 51 by the clutch means 52, which is shown by the signal CL1. At this time, the sheet is already transferred to the register position and waits for a while, its front end contacting with the register roller pair 13.

(3) When the write signal WRITE is turned on, the print controller 43 generates a command to begin the printing operation, whereby the light beam begins to be scanned on the photoconductive drum 20, the beam being modulated by the printing information. Further with the WRITE command, the synchronous delay time data $T_3$ is loaded in the inner timer means 40*a*. The timer means counts the delay time for the sheet to wait after the generation of WRITE command. This synchronous delay time is required to adjust the movement of the sheet to reach the image transfer device 24 synchronous with the rotation of the photoconductive drum 20.

(4) When the timer means 40*a* counts down $T_3$, clutch signals CL1 and CL2 are turned on. Each of clutch means 52 and 53 connects the driving torque from the main motor 51 to the feed roller pair 12 and register roller pair 13 respectively.

At the same time the signals CL1 and CL2 are turned on, another time data $T_4$ is loaded in the outer timer means 42. $T_4$ is the expected and necessary duration for the clutch means 52 to operate. When the outer timer means 42 counts down $T_4$, signals CL1 is turned off and the feed roller pair 12 is disconnected from the main motor 51. At the end of WRITE command, the additional time data $T_a$ is counted, and at the end of $T_a$, CL2 signal is turned off and the register roller pair 13 is disconnected from the main motor 51. At this moment, the bottom end of the sheet completely passes through the register roller pair 13. At the same time CL2 is turned off, the outer timer means 42 is loaded with another time data $T_5$ and begins to count until the sensor 32 detects a complete ejection of the sheet.

During the time duration $T_4$, the write process on the photoconductive drum 20 by the optical system 22 for one page of sheet is completed as seen by the WRITE signal of FIG. 7. Therefore, the printing unit 2 becomes ready to receive again the printing command PRT. As seen from FIG. 7, the steps (1) and (2) of separating and transferring operation for the next sheet begin while the previous sheet is still remaining in the printing unit 2.

(5) The above time data $T_5$ loaded in outer timer means 42 is the expected time duration for the specific sheet to travel after CL2 is turned off till the bottom end of the sheet passes over the sensor 32. The sensor 32 sends a signal HOS as shown in FIG. 7, and the signal change the state from off to on states during the sheet is passing over the sensor. If the actual counted time TM exceeds the time data $T_5$, it indicates the sheet is jammed in the printing unit 2 or in the ejecting unit 3. In this case, the step is jumped to step (7). When the outer timer means 42 counts $T_5$ and the signal from the sensor 32 indicates the specific sheet is already ejected into a stacker, all process steps are finished for this sheet.

(6) On the other hand, if the sensor 14 does not detect the arrival of the front end of the sheet in step (2) at the time when the inner timer means counts down $T_2$, it shows that the sheet is jammed in the feeding unit 1. The CL1 signal is turned off, disconnecting the feed roller pair 12 from the main motor 51 by the clutch means 52, and thus further progress of jamming is avoided.

At this moment, because the main motor 51 and the printing and ejecting units 2 and 3 are still working, therefore, the previous sheets remaining in these units continue to move and finally the printed sheets are ejected. The control processor 40 is watching the signal HOS output from the sensor 32 and judges whether all sheets other than the jammed sheet are ejected or not.

(7) After confirming the ejection of all sheets, the main motor 51 is stopped as shown by the dashed line of the MAIN signal in FIG. 7, and the operations of the printing unit 2 and ejecting unit 3 are stopped.

When the sheet jamming occurs in the feeding unit 1, which is detected in step (2), the operation in the feeding unit 1 is stopped immediately in step (6), and after the confirmation of an ejection of all previous sheets, the operation of other printing and ejecting units 2 and 3 are stopped, and the alarm lamp is lit on the operator panel.

The operator's work for the recovery from the jamming trouble is to remove only one jammed sheet. No other sheet is remaining in the printing station. There is no contamination of components by toner powder. When the sheet jamming occurs in the feeding unit 1 of a high speed printing station, the previous sheets are not spoiled and may be used according to the present invention.

In the above explanation, the inner timer means **40*a* and outer timer means 42 are used. Here, the operation of the inner timer means 40*a* is explained in more detail using FIG. 8**.

The control processor 40 loads the predetermined data such as $T_1$, $T_2$ and $T_3$, which are stored in the memory unit 41 as explained previously, into the inner registers (not shown) which are comprised within the control processor 40. Every time when the counter in the control processor 40 counts a predetermined number of clocks such as 100 (a clock period, for example, 1 micro-second), the interruption signal is generated and the interruption routine as shown in FIG. 8 starts. FIG. 8 shows the interruption routine, wherein the inner timer means **40*a*** functions of comparing the measured time with $T_1$, $T_2$ or $T_3$, each being stored in the register. At the first step of interruption, T value stored in the register is judged whether T is zero or not. If the T value is not zero, T value in the register is replaced by T-1 as the second step, and the step goes out of the interruption routine. And each time of interruption, the steps are repeated from the first step to the second steps. Finally as the last step, when the $T_3$ value becomes zero, the counting process using the inner timer means is completed and the process goes to the next one.

The modification of the embodiment will herein be described.

In the above embodiment, all transport means are driven by single main motor 51, however, another motor may be provided which drives the transport means used only in the feeding unit 1 such as the separating roller 11, feed roller pair 12, and register roller pair 13. In the printing unit 2, the above embodiment utilizes the photoconductive drum 20 and the toner powder to develop the latent image formed thereon. However, the present invention may be applied for other printing methods such as thermal recording, electrostatic recording, and thermal transfer recording methods. All transport means in the embodiment are explained as of a pinch-roller type, however, many other types of transporting means are available for the present invention.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the forgoing description, and all changes which come within the meaning and range of equivalence of the claims are, therefore, to be embraced therein.

What is claimed is:

1. A control method for transport means transporting a cut sheet in a printing station, wherein said printing station comprises a printing unit, a first transport means for transferring the cut sheet along a first passage from a first storing position of cut sheets to said printing unit, a second transport means for transferring the cut sheet along a second passage from said printing unit to a second storing position by ejecting the cut sheet, and a first detector means for detecting a jamming of the cut sheet along said first passage, said control method comprising the sequential steps of:

(a) detecting the sheet jamming along said first passage by using said first detector means;

(b) stopping said first transport means when the sheet jamming is detected by said first detector means and continuing operation of said second transport means at least until cut sheets remaining along said second passage are ejected into the second storage position; and (c) stopping said second transport means after the cut sheets remaining along said second passage are ejected into the second storing position.

2. A control method according to claim 1, wherein said printing unit includes an inlet and said step (a) further comprises the sub-steps of:

detecting the sheet jamming by measuring a first duration for the cut sheet to travel between a specified starting position and a position before the inlet to said printing unit along said first passage;

comparing said measured first duration with a first predetermined time data; and determining that sheet jamming has occurred when said measured first duration is larger than said first predetermined time data.

3. A control method according to claim 1, further comprising the steps of separating and transferring each of the cut sheets sequentially one by one while previously separated and transferred sheets moving through said printing unit and along said second passage.

4. A control method according to claim 1, wherein said printing station includes a register position and a printing position in said printing unit, said control method further comprising the steps of:

holding the cut sheet at the register position for a predetermined period; and transferring the cut sheet to the printing position in said printing unit when a synchronous condition for printing is satisfied.

5. A control method according to claim 1, wherein said printing station includes a main motor coupled to said first and second transport means and a clutch means for coupling the main motor to said first transport means.

6. A control method according to claim 1, wherein said first and second transport means provided along said first and second passages comprise pinch-roller pairs.

7. A control method according to claim 6, wherein said printing unit includes an inlet and wherein said first transport means provided along said first passage comprises a register roller pair located near the inlet of said printing unit, said first detector means being disposed within said first transport means in a close vicinity before said register roller pair.

8. A control method for transport means transporting a cut sheet in a printing station, wherein said printing station comprises a printing unit, a first transport means for transferring the cut sheet along a first passage from a first storing position of cut sheets to said printing unit, a second transport means for transferring the cut sheet along a second passage from said printing unit to a second storing position by ejecting the cut sheet, a first detector means for detecting a jamming of the cut sheet along said first passage, and a second detector means for detecting an ejection of the cut sheet from said second passage, said control method comprising the sequential steps of:

(a) detecting the sheet jamming along said first passage by using said first detector means;

(b) stopping said first transport means when the sheet jamming is detected by said first detector means and continuing operation of said second transport means at least until said second detector means detects that cut sheets remaining along said second passage are ejected into the second storing position; and (c) stopping said second transport means after said second detector means detects that the cut sheets remaining along said second passage are ejected into the second storing position.

9. A control method according to claim 8, said control method further comprising the sequential steps of:

(d) detecting sheet jamming in said printing unit and along said second passage by using said second detector means; and (e) stopping said first and second transport means when the sheet jamming is detected by said second detector means.

10. A control method according to claim 9, wherein said printing unit includes an inlet and said step (a) further comprises the sub-steps of;

detecting the sheet jamming by measuring a second duration for the cut sheet to travel between the inlet of said printing unit and a position of said second detector means;

comparing said measuring second duration with a second predetermined time data; and determining that sheet jamming has occurred when said measured second duration is larger than said second predetermined time data.

11. A control method according to claim 8, further comprising the step of separating and transferring the cut sheet from the cut sheets sequentially one by one while previously separated and transferred sheets are still remaining in said printing unit and moving along said second passage.

12. A control method according to claim 9, further comprising the steps of separating and transferring the cut sheet from the cut sheets sequentially one by one while previously separated and transferred sheets are still remaining in said printing unit and moving along said second passage.

13. A control method and transport means according to claim 8, wherein said first and second transport means are coupled to a main motor and said first transport means provided along the first passage is coupled to said main motor by a clutch.

14. A control method for transport means according to claim 9, wherein said first and second transport means are coupled to a main motor and said first transport means provided along the first passage is coupled to said main motor by a clutch.

15. A control method for transport means according to claim 8, wherein said first and second transport means provided along the first and second passages comprise pinch-roller pairs.

16. A control method for transport means according to claim 9, wherein said first and second transport means provided along the first and second passages comprise pinch-roller pairs.

17. A printing station for cut sheets comprising;

a printing unit for printing on the cut sheets;

first transport means for transferring the cut sheets along a first passage from a first storing position of the cut sheets to said printing unit;

second transport means for transferring the cut sheets along a second passage from said printing unit to a second storing position by ejecting the cut sheets;

first detector means for detecting a sheet jamming along the first passage; and control means for starting and stopping said first and second transport means independently, said control means comprising means for detecting the sheet jamming along the first passage dependent upon said first detector means, stopping said first transport means and continuing operation of said second transport means when the sheet jamming is detected along the first passage and maintaining said first transport means in a stopped state at least until the cut sheets remaining along the second passage are ejected into the second storing position and stopping said second transport means when the cut sheets remaining along the second passage are ejected into the second storing position.

18. A printing station according to claim 17, wherein said printing unit comprises a photoconductive drum forming an electrostatic latent image thereon, a developing device for developing the latent image into a toner image, and an image transfer device for transferring the toner image onto the cut sheet.

19. A printing station of a cut sheet according to claim 11, wherein said first transport means comprises a separating roller which separates each cut sheet one by one from the stacked sheets at the first storing position, and a roller means for transferring the cut sheet to said printing unit.

20. A printing station according to claim 18, wherein said first transport means comprises a separating roller which separates each cut sheet one by one from the stacked sheets at the first storing position, and a register roller for transferring the cut sheet synchronized with a movement of said photosensitive drum, and said second with a movement of said photosensitive drum, and said second transport means comprises a fixing roller wherein the transferred toner image on the cut sheet is fixed and conveying and ejecting rollers which convey and eject the cut sheet to the second storing position.

21. A printing station according to claim 20, wherein said second transport means further comprises a motor which generates a driving torque, and a transmission means for transmitting the driving torque to said conveying and ejecting rollers, and said first transport means comprises transmission and interruption means for transmitting and interrupting the driving torque to said separating and register rollers respectively.

22. A printing station according to claim 21, wherein said control means comprises means for stopping said first transport means by activating said interruption means, and stopping said second transport means by stopping said motor.

23. A printing station for a cut sheet comprising:

a printing unit for printing on the cut sheet;

first transport means for transferring the cut sheet along a first passage from a first storing position of cut sheet to said printing unit;

second transport means for transferring the cut sheet along a second passage from said printing unit to a second storing position by ejecting the cut sheet;

first detector means for detecting a jamming of the cut sheet along the first passage;

second detector means for detecting an ejection of the cut sheet from the second passage;

control means for starting and stopping said first and second transport means independently, said control means comprising means for detecting the sheet jamming along the first passage dependent upon said first detector means, stopping said first transport means and continuing operation of said second transport means when the sheet jamming is detected along the first passage and maintaining said first transport means in a stopped state at least until said second detector means detects that the cut sheets remaining along the second passage are ejected into the second storing position and stopping said second transport means when said second detector means detects that the cut sheets remaining along the second passage are ejected into the second storing position.

24. A printing station of a cut sheet according to claim 23, wherein said printing unit comprises a photoconductive drum wherein an electrostatic latent image is formed thereon, a developing device operatively connected to said drum for developing the latent image into a toner image, and an image transfer device operatively connected to said developing device for transferring the toner image onto the cut sheet.

25. A printing station of a cut sheet according to claim 23, wherein said first transport means comprises a separating roller which separates each cut sheet one by one from the stacked sheets at the first storing position, and a roller for transferring the separated cut sheet to said printing unit.

* * * * *

UNITED STATES PATENT AND TRADEMARK OFFICE

CERTIFICATE OF CORRECTION

PATENT NO. : 4,878,428

DATED : November 7, 1989

INVENTOR(S) : Shinichi Watarai

It is certified that error appears in the above-identified patent and that said Letters Patent is hereby corrected as shown below:

Col. 3, line 33, "3 then" s/b --3 is then--.

Col. 6, line 53, "change" s/b --changes--.

Col. 11, line 12, "sheet" s/b --sheets--.

Signed and Sealed this

Fifth Day of March, 1991

*Attest:*

HARRY F. MANBECK, JR.

*Attesting Officer*

*Commissioner of Patents and Trademarks*